United States Patent [19]

Ishikura

[11] Patent Number: 4,599,828

[45] Date of Patent: Jul. 15, 1986

[54] TILE HAVING NOZZLE AND MEANS FOR FIXATION THEREOF TO A ROOF

[76] Inventor: Nanako Ishikura, 15-9, Enkohjihonmachi, Kanazawa-shi, Ishikawa-ken, Japan, 921

[21] Appl. No.: 719,813

[22] Filed: Apr. 4, 1985

[30] Foreign Application Priority Data

Apr. 4, 1984 [JP] Japan ..... 59-50010[U]
Apr. 4, 1984 [JP] Japan ..... 59-50011[U]

[51] Int. Cl.[4] ..... E04D 1/34

[52] U.S. Cl. ..... 52/19; 52/221; 52/512; 52/543

[58] Field of Search ..... 52/19, 24, 27, 57, 110, 52/199, 221, 506, 509, 512, 543, 544, 549, 550; 285/404

[56] References Cited

U.S. PATENT DOCUMENTS

| | | | |
|---|---|---|---|
| 706,684 | 8/1902 | Peter | 52/24 |
| 1,269,912 | 6/1918 | Dunham | 411/344 |
| 2,611,459 | 9/1952 | Hammitt | 52/550 |
| 2,665,147 | 1/1954 | Weismann | 52/221 |
| 2,908,745 | 10/1959 | Appleton | 285/404 |

FOREIGN PATENT DOCUMENTS

| | | | |
|---|---|---|---|
| 615327 | 2/1961 | Canada | 52/199 |
| 784625 | 5/1968 | Canada | 52/514 |
| 58-195716 | 12/1983 | Japan . | |
| 631226 | 7/1982 | Switzerland | 52/24 |
| 295798 | 6/1927 | United Kingdom | 52/27 |
| 2049757 | 5/1979 | United Kingdom | 52/57 |

*Primary Examiner*—Henry E. Raduazo
*Assistant Examiner*—Dan W. Pedersen
*Attorney, Agent, or Firm*—Wenderoth, Lind & Ponack

[57] ABSTRACT

A roof tile having a lead-in hole for antenna cords or other elongated bodies of rooftop fixtures comprises a tile body, a pedestal integrally formed on the upper central surface of the tile body, a nozzle integrally formed on the pedestal, and a pipe joint having a base and a bent leading end. The pedestal has a bolt hole bored therein so as to pierce through the tile body for inserting an anchor bolt thereinto to fix the tile body to a roof board. The nozzle has an annular rib formed on the upper periphery thereof and a nozzle hole formed therein so as to pierce through both the pedestal and the tile body for serving as the lead-in hole. The base of the pipe joint is adapted to be fitted around the nozzle and fixed to the nozzle with a bolt screwed therein and brought into collision contact with the periphery of the nozzle at a position below the annular rib. The bent leading end of the pipe joint is directed to the upper surface of the tile body.

6 Claims, 8 Drawing Figures

TILE HAVING NOZZLE AND MEANS FOR FIXATION THEREOF TO A ROOF

BACKGROUND OF THE INVENTION

1. Field of the Invention

The present invention relates to a roof tile for supporting and fixing rooftop fixtures such as an antenna of television or communication apparatus and equipment, a heat collector panel in a solar energy system, etc. and more particularly relates to a roof tile having a construction of wiring antenna cords or arranging hot and cold water supply pipes.

2. Description of the Prior Art

Generally, an antenna of communication apparatus and equipment or a heat collector panel in a solar energy system is set in position on a roof. If the roof is tiled, it is very difficult to fix these rooftop fixtures directly to the tile surface in view of the material of the tile.

In recent years, however, there has been proposed a tile made of metal, provided with fitting/supporting means which comprises a pedestal and an upright portion for fixing an antenna pole or a fitting piece of a heat collector panel to the tile surface with a fastener, and adapted to be fixed to a shingle (Japanese Utility Model Public Disclosure No. 58(1983)-195716). Since this tile has the fitting/supporting means formed integrally therewith, it can firmly be attached to a shingle and is very effective for preventing an antenna etc. from overturning under strong-wind conditions.

Although the antenna etc. is firmly supported by the tile, as described above, the antenna cord or hot and cold water supply pipe is laid along the surface of a roof or wall and led into the interior of a house through a hole bored in the roof or wall surface. This does aesthetic harm to the house and is undesirable from a standpoint of wiring or piping work.

Further, in fixing a roof tile to a shingle, there has been adopted a method of fixing the roof tile to a roof rafter, one of the foundation materials, with bolts. This method requires the steps of boring the roof rafter to form holes for the bolts and removing a roof board to some extent, and sometimes necessitates work from an attic. Thus, the conventional method makes the work difficult and adversely affects the house to a great extent because of the necessity of detachment of the surrounding tiles, excision of the roof board and possible excision of the ceiling.

SUMMARY OF THE INVENTION

One object of the present invention is to provide a tile adapted to be advantageously used in wiring an antenna cord or arranging a hot and cold water supply pipe and leading the cord or pipe into the attic. The tile is easily fixed firmly to a roof board while minimizing adverse influence on a house.

According to the present invention, it is possible to fix the tile fast to the roof board by laying between roof rafters a columnar erection member having the head of an anchor bolt supported pivotally thereon, inserting the anchor bolt into a nozzle hole bored in the tile, and holding the anchor bolt in its place with a nut. Since the head of the anchor bolt is pivotally supported on the columnar erection member, the columnar erection member can easily be inserted below the roof rafters and then laid between the roof rafters. The nozzle integrally formed with the tile can serve as the base portion of a pipelike prop which is the base stand of an antenna or other rooftop fixtures. Further, the tile having the nozzle can be used as a part constituting the perforation portion of the roof for the antenna cable or hot and cold water supply pipe when a U-shaped pipe joint is fitted around the nozzle.

The aforementioned and other objects, advantages and characteristic features of the present invention will become apparent to those skilled in the art as the disclosure is made in the following description of preferred embodiments of the invention, as illustrated in the accompanying drawings.

DETAILED DESCRIPTION OF THE PREFERRED EMBODIMENTS

The present invention will now be described with reference to the illustrated embodiments.

Figure 1:
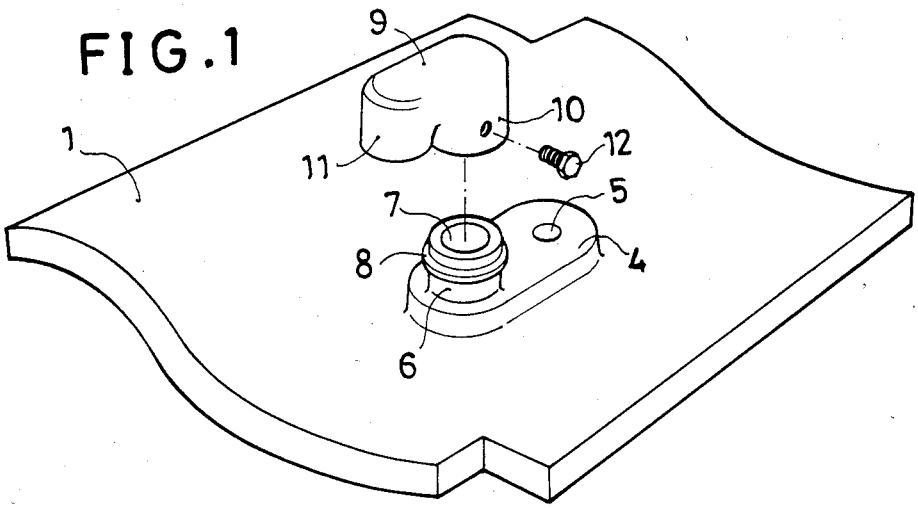
FIG. 1 is an exploded perspective view illustrating the principal part of one embodiment of the tile according to the present invention.

FIG. 1 is a perspective view showing the principal part of a tile 1 according to the present invention. The tile 1 is provided on the upper central surface thereof integrally with a pedestal 4 extending along the runoff direction. The pedestal 4 is provided thereon with a nozzle 6 projecting upwardly and having a nozzle hole 7 pierced through the tile 1. The pedestal 4 may be formed in any shape. However, it is preferable to form the pedestal 4 in an ellipsoidal shape so as to allow rainwater to run smoothly. The nozzle 6 has an annular rib 8 formed on the upper periphery thereof. A substantially U-shaped pipe joint 9 is fitted around the nozzle 6 at the base 10 thereof and fixed to the nozzle 6 by a number of bolts 12 which are driven into the base 10 of the pipe joint 9 and brought into collision against the periphery of the nozzle 6 below the annular rib 8. The leading end 11 of the pipe joint 9 is bent downwardly (toward the upper surface of the tile 1). The outside of the bend leading end 11 is slightly longer than the inside thereof. The inside diameter of the pipe joint 9 is large enough so as to be engaged with the annular rib 8 of the nozzle 6.

The pedestal 4 has a bolt hole 5 bored therein so as to pierce through the tile 1. The tile 1 is fixed to a house by inserting an anchor bolt into the bolt hole 5 and holes in a roof board and a roof rafter and holding the anchor bolt in its position with a nut.

Figure 2:
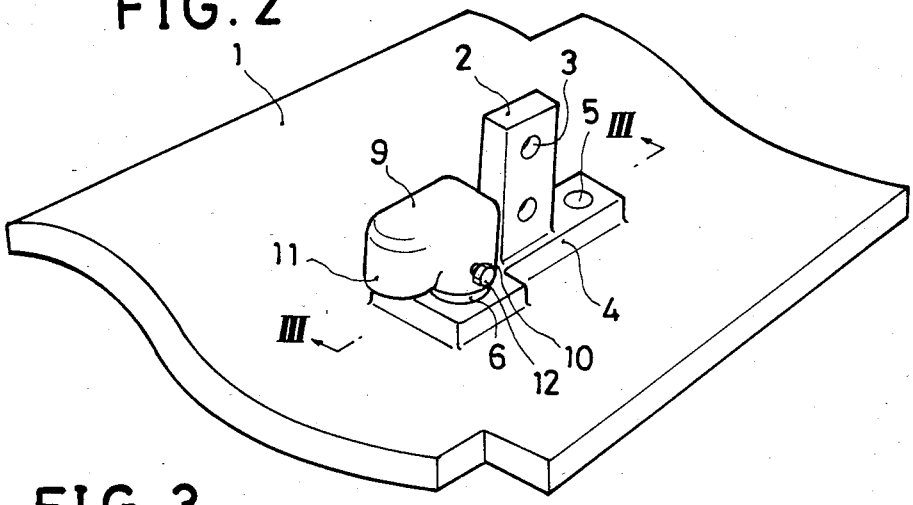
FIG. 2 is a perspective view illustrating another embodiment of the tile according to the present invention.
Figure 3:
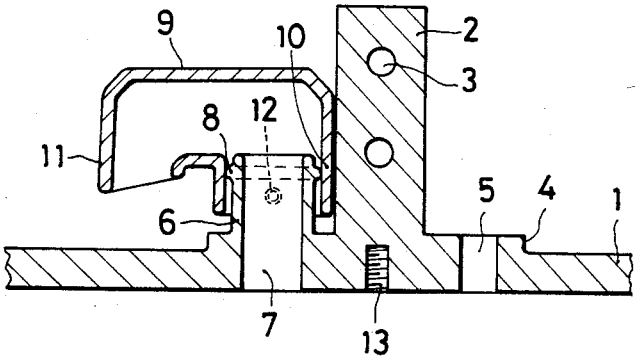
FIG. 3 is a longitudinal cross section taken along the line III—III in FIG. 2.
Figure 4:
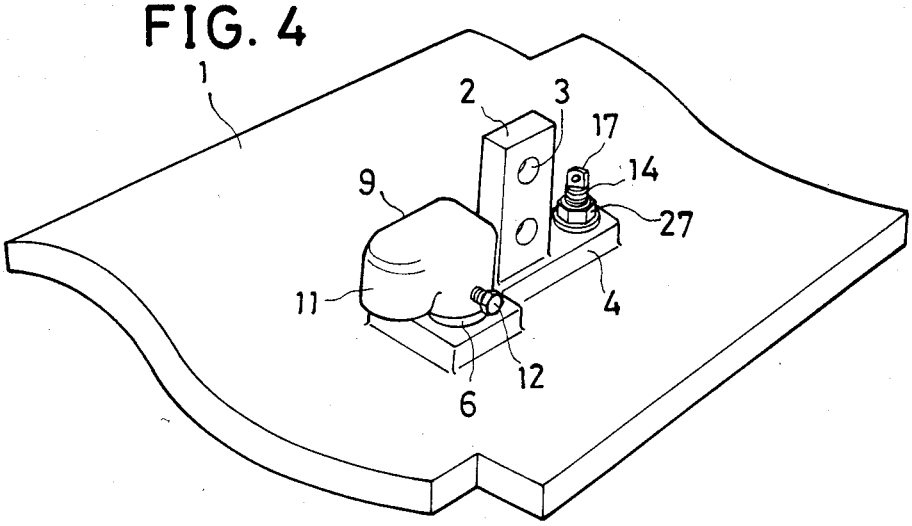
FIG. 4 is a perspective view illustrating the tile according to the present invention as fixed by an anchor bolt.

FIG. 2 is a perspective view showing the second embodiment of the tile 1 according to the present invention. A pedestal 4 has an upright portion 2 formed integrally therewith and provided in the center thereof with bolt holes 3. On the upright portion 2, there is supported the lower portion of an antenna pole by utilization of the bolt holes 3 and bolts. An antenna cord of an antenna set in position on the antenna pole which has been attached to the upright portion 2 is inserted into a pipe joint 9, guided into an attic below the tile 1 through a nozzle hole 7 of a nozzle 6, and distributed to rooms throughout the house. FIG. 3 is a longitudinally cross-sectional front view taking along the line III—III in FIG. 2, in which an auxiliary bolt hole 13 is formed in the tile 1.

Figure 5:
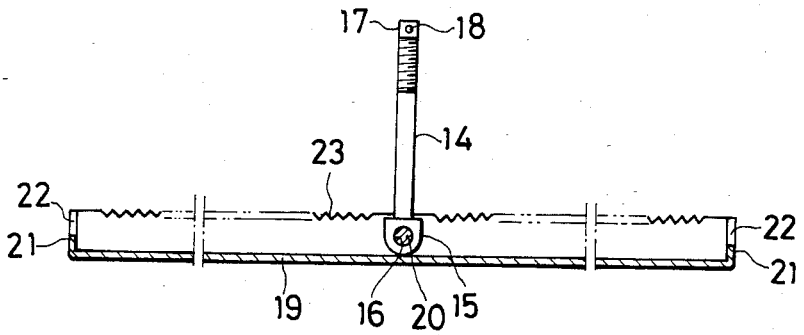
FIG. 5 is a partially sectioned front view illustrating the anchor bolt and a columnar erection member used in the embodiment of FIG. 4.

FIGS. 4 to 8 show an example of a method for fixing the tile 1 of the present invention to the roof by means of an anchor bolt 14. As shown in FIG. 5, anchor bolt 14 has a head 15 which has a hole 16 and a flat leading end 17 which has a through aperture 18. A shaft 20 which is laid on the substantially central portion of a columnar erection member 19 is loosely inserted into the hole 16 in the head 15 of the anchor bolt 14.

Since the shaft 20 is laid at right angles relative to the lengthwise direction of the columnar erection member 19, the anchor bolt 14 is supported pivotally in the lengthwise direction of the columnar erection member 19. The leading end 17 of the anchor bolt 14 is flat in the lengthwise direction of the columnar erection member 19. Since the anchor bolt 14 is set in position, as described above, the direction of the columnar erection member 19, as shown in FIG. 6 disposed within an attic, can be recognized from above a roof and, therefore, it is possible to precisely lay the columnar erection member 19 between roof rafters 24.

The columnar erection member 19 is a long member having a cross section shown in FIG. 5 of the three sides of a quadrilateral and is preferably provided in the opposite end walls 21 thereof with notches 22 having upper openings. By forming the columnar erection member 19 as described above, the columnar erection member 19 can easily be inserted into a through hole 26 shown in FIG. 6 in a roof board 25, with the anchor bolt 14 completely accommodated within the columnar erection member 19. Further, the columar erection member 19 is preferably provided in the upper edges of the side walls thereof with corrugations 23 (FIG. 5), as nonskid means relative to the roof rafters 24 (FIG. 6).

The columnar erection member 19 may be made of any material. In view of durability etc., however, it is desired to be made of metal. Further, it is fundamentally desired that the columnar erection member 19 be formed in the shape of a rectangular pillar. The shape of the columnar erection member 19 should not limited to that shown in the drawings. It may optionally be formed in the shape of an ordinary box and, in this case as shown in FIG. 5, the head 15 of the anchor bolt 14 is pivotally supported by a bearing (not shown) which projects from the upper surface of the box-shaped erection member 19. The length of the columnar erection member 19 is required to be larger than the distance between the roof rafters 24 and that of the anchor bolt 14 is required to be not less than the sum total of the thicknesses of the roof rafter 24, roof board 25 and tile 1.

Figure 6:
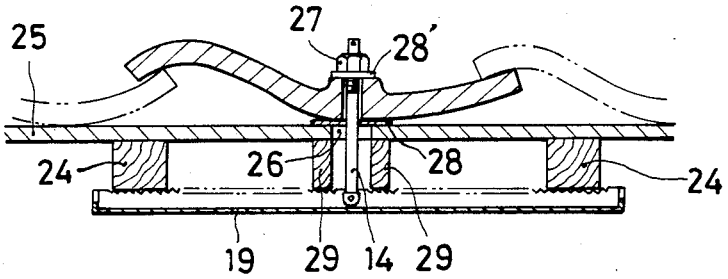
FIG. 6 is a cross-sectional view illustrating the tile according to the present invention as fixed by the use of the anchor bolt.

FIG. 6 is a cross section showing the tile 1 as fixed by the use of the anchor bolt 14. The columnar erection member 19 is laid between the blower surfaces of the roof rafters 24, and the anchor bolt 14 is upwardly projected from the through hole 26 in the roof board 25, passed through the bolt hole 5 (FIG. 3) in the tile 1 and held in its position with a nut 27 (FIG. 6). Therefore, by tightening the anchor bolt 14 with the nut 27, the roof rafters 24 and roof board 25 are firmly pinched between the columnar erection member 19 and the tile 1, with the result that the tile 1 is fixed fast to the roof. In FIG. 6, washers 28 and 28′ and auxiliary lumbers 29 are disposed as occasion demands. In place of washers 28 and 28′, packing may be used.

Figure 7:
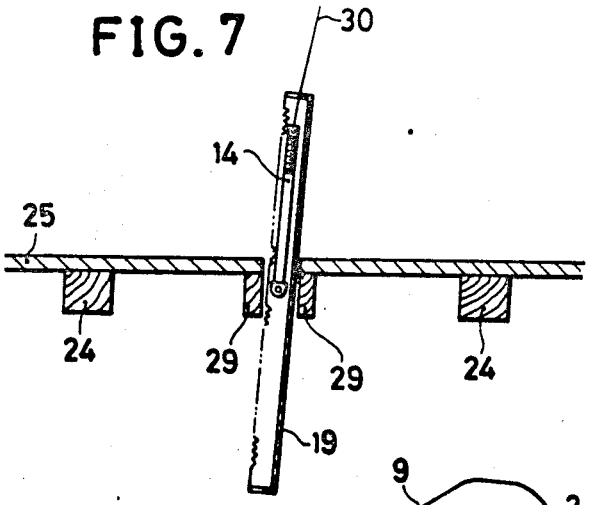
FIG. 7 is an explanatory view illustrating a method for using the anchor bolt.

As shown in FIG. 7, columnar erection member 19 is laid between the roof rafters 24 by inserting one end of a piece of string 30 such as a wire into the through aperture 18 (FIG. 8) in the flat leading end 17 of the anchor bolt 14 and joining the string 30 and the anchor bolt 14 together as shown in FIG. 7, rotating the anchor bolt 14 until it is completely accommodated within the columnar erection member 19 to extend the string 30 from the notch 22 (FIG. 8) in the end wall 21 of the columnar erection member 19, passing the columnar erection member 19 downward through the through hole 26 (FIG. 6) in the roof board 25 (FIG. 7) while holding the string 30, pulling the string 30 up after the columnar erection member 19 is held substantially horizontally below the roof rafters 24 by its own weight, causing the anchor bolt 14 to be projected upwardly from the roof board 25, passing the anchor bolt 14 through the bolt hole 5 (FIG. 8) in the tile 1 and while being held in its place with the nut 27, and thereafter removing the string 30 (FIG. 7) from the leading end 17 (FIG. 8) of the anchor bolt 14. Since the string 30 (FIG. 7) is fastened to the through aperture 18 (FIG. 8) in the flat leading end 17 of the anchor bolt 14, it limits its moving range within the width of the anchor bolt 14 and therefore, it does not hinder the nut 27 from being inserted around the anchor bolt 14.

With the construction of the present invention as described above, it is possible to lead an antenna cord into a house at the shortest distance from an antenna, to enjoy good external appearance, and to prevent injury and damage of the antenna cord which has heretofore suffered by the conventional construction because the antenna cord has been stretched around a house.

Figure 8:
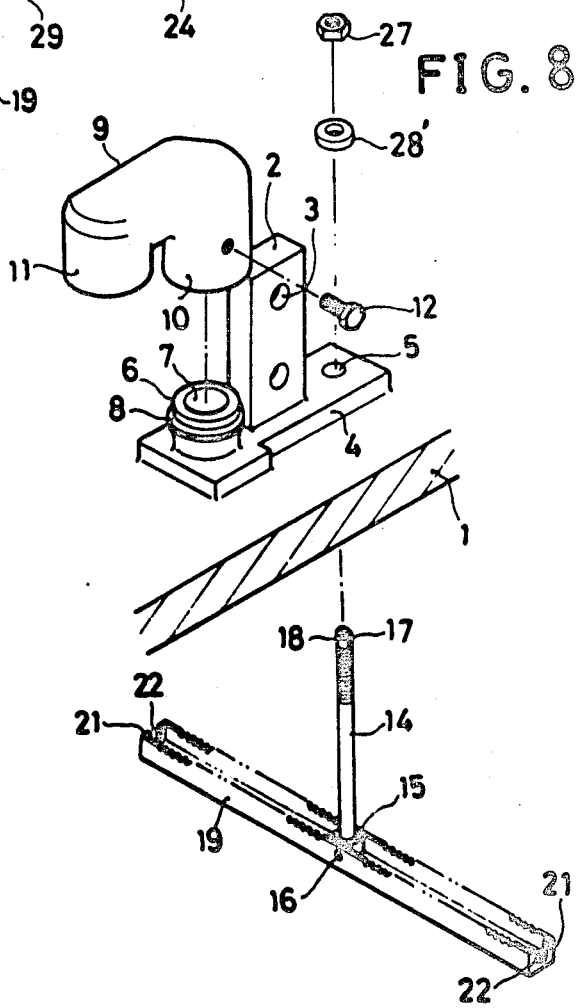
FIG. 8 is an exploded perspective view illustrating the principal part of the tile according to the present invention.

On the other hand as shown in FIG. 8, the connection between the base 10 of the pipe joint 9 and the nozzle 6 is obtained by the bolt 12 screwed in the base 10 and brought into collision contact with the outer circumference of the nozzle 6. Since the annular rib 8 is formed on the outer circumference of the nozzle 6, if the bolt 12 should be loosened to cause the pipe joint 9 to float due to a wind etc., there is no fear of the pipe joint 9 coming off the nozzle 6 because the bolt is stopped by the annular rib 8. Further, since the leading end 11 of the pipe joint 9 is bent downwardly and has its outside made slightly longer than its inside, it is possible to prevent rainwater etc. from entering the pipe joint 9 and to effectively intercept the repelled rainwater. Furthermore, since the nozzle 6 and the pipe joint 9 are separate parts, an antenna cord of an antenna of television or communication apparatus and equipment or a hot and cold water supply pipe of a heat collector panel in a solar energy system can easily be inserted into a hole in the roof board 25 (FIG. 6) through the nozzle 6 (FIG. 8) as separated from the pipe joint 9 and also into the pipe joint 9 in the state of separating from the nozzle 6.

The tile 1 of the present invention is preferably made of metal from the standpoint of strength and durability and, from the standpoint of light weight and durability, further preferably made of aluminum or aluminum alloy. Tile 1 may be made of a ceramic, cement or plastic material if the strength thereof suffices.

The number of the tiles 1 of the present invention may be determined depending on the number of rooftop fixtures to be set in position on the roof and, on the remaining portion of the roof, ordinary tiles may be laid. Therefore, the tile 1 of the present invention shown in FIG. 2 is formed in a shape conforming to that of an ordinary tile, except for the portions of the pedestal 4 and the nozzle 6, so as to be interchangeable with an ordinary tile. As shown in FIGS. 7 and 8, the tile of the present invention can firmly be fixed to the roof board 25 by the use of the aforementioned anchor bolt 14 and can sufficiently bear the weight of rooftop fixtures. Further, since it is only required to form in the roof board 25 a hole 26 (FIG. 6) sufficient for the columnar erection member 19 to be inserted thereinto in the attachment of the tile 1 of this invention, the work can be easily carried out and adverse influence on a house in the work can be reduced to the fullest extent.

What is claimed is:

1. A roof tile having a lead-in hole for securing antenna cords or other elongated bodies of rooftop fixtures to a roof board, comprising:

a tile body, a pedestal integrally formed on an upper central surface of said tile body and having a hole bored therein so as to pierce through said tile body, an anchor bolt inserted into the tile body so as to fix said tile body to the roof board, a nozzle integrally formed on said pedestal so as to project upwardly and having an annular rib formed on an upper periphery thereof and a hole formed therein as said lead-in hole so as to pierce through said pedestal and said tile body, and a pipe joint composed of a base which is adapted to be fitted around said nozzle and fixed to said nozzle and brought into contact with a periphery of said nozzle at a position below said annular rib.

2. A roof tile according to claim 1, wherein:

said pedestal is further provided integrally with an upright portion which is disposed adjacent to said nozzle and has means for attaching and supporting a lower portion of said rooftop fixtures to said upright portion.

3. A roof tile according to claim 1, wherein:

a leading end of said pipe joint is bent downwardly toward the upper surface of the tile body and has its outside edge made slightly longer than its inside edge.

4. A roof tile according to claim 1, wherein said tile body is made of aluminum.

5. A roof tile according to claim 1, wherein said tile body is made of aluminum alloy.

6. A roof tile according to claim 1, further comprising:

a columnar erection means, pivotally supported at one end of the anchor bolt, for allowing said anchor bolt to be rotatable in the lengthwise direction of said columnar erection means so that the anchor bolt is inserted into the hole in the pedestal for fixing the tile body to the roof board.

* * * * *